US005228843A

United States Patent [19]

Novolan et al.

[11] Patent Number: 5,228,843

[45] Date of Patent: Jul. 20, 1993

[54] COMPRESSOR FOR DOMESTIC REFRIGERATORS

[75] Inventors: Traian Novolan, Tirgoviste; Ilie Ungurean; Petru Nistor, both of Gaesti; Dumitru Bordea; Ioan Paulescu, both of Bucharest; Matei Sandu; Stefan Saru, both of Gaesti, all of Romania

[73] Assignee: Intreprinderea de Frigidere Gaesti, Gaesti, Romania

[21] Appl. No.: 678,264

[22] PCT Filed: Sep. 21, 1990

[86] PCT No.: PCT/RO90/00002

§ 371 Date: Apr. 18, 1991

§ 102(e) Date: Apr. 18, 1991

[87] PCT Pub. No.: WO91/05165

PCT Pub. Date: Apr. 18, 1991

[30] Foreign Application Priority Data

Oct. 6, 1989 [RO] Romania ..... 141894

[51] Int. Cl.[5] ..... F04B 35/04

[52] U.S. Cl. ..... 417/363; 417/372; 184/6.18

[58] Field of Search ..... 417/363, 368, 372, 902; 184/6.18, 6.16

[56] References Cited

U.S. PATENT DOCUMENTS

| | | | |
|---|---|---|---|
| 3,306,524 | 2/1967 | Matuki et al. | 417/363 |
| 3,441,202 | 4/1969 | Valbjorn et al. | 417/363 |
| 3,663,127 | 5/1972 | Cheers | 417/902 |
| 4,086,033 | 4/1978 | Stephan | 417/368 |
| 4,194,264 | 3/1980 | Morse | 62/503 |
| 4,209,080 | 6/1980 | Douglas | 417/902 |
| 4,576,555 | 3/1986 | Ashenfelter | 417/902 |
| 4,582,468 | 4/1986 | Bar | 417/902 |
| 4,793,775 | 12/1988 | Peruzzi | 417/312 |

FOREIGN PATENT DOCUMENTS

| | | |
|---|---|---|
| 1006489 | 3/1977 | Canada . |
| 3242858 | 3/1984 | Fed. Rep. of Germany . |
| 3534819 | 6/1986 | Fed. Rep. of Germany . |
| 3715661 | 11/1987 | Fed. Rep. of Germany . |
| 8602703 | 5/1986 | World Int. Prop. O. . |

*Primary Examiner*—Richard A. Bertsch
*Assistant Examiner*—Charles G. Freay
*Attorney, Agent, or Firm*—Herbert Dubno

[57] ABSTRACT

A compressor for a domestic refrigerator has a horizontally oriented cylinder assembly at the top of a motor with a body forming a suction passage connected to the cylinder depending from the latter along side the motor and juxtaposed with a wall of a lower housing part holding the oil which is pumped through the shaft of the motor to the eccentric. The body has a suction port spaced from but aligned with a hole in the wall to which the refrigerant is delivered by a tube terminating at that wall.

4 Claims, 6 Drawing Sheets

COMPRESSOR FOR DOMESTIC REFRIGERATORS

CROSS REFERENCE TO RELATED APPLICATIONS

This application is a national phase application of PCT/RO 90/00002 filed 21 Sep. 1990 and based, in turn, on a Romanian application No. 141894 of 6 Oct. 1989 under the International Convention.

FIELD OF THE INVENTION

The invention relates to a compressor for domestic refrigerators completely enclosed and functioning with Freon.

According to the invention, the compressor for domestic refrigerators is provided with a hollow body, so disposed that a circular hole of it, through which it enters in the cylinder subassembly, the working fluid is arranged in line with a tube through which the fluid vapor is delivered from the evaporator and has springs mounted on the bottom of the housing and an oil pump formed in the shaft.

This structure is designed, to increase the storage space in the cabinet, as well as to enhance the refrigerating efficiency, positively affecting the power consumption.

BACKGROUND OF THE INVENTION

Compressors for domestic refrigerators functioning with Freon and provided with a housing are known. Inside the housing there is an electric motor provided with a shaft entraining an eccentric which, in turn, entrains a piston inside a cylinder subassembly.

The Freon, which is the working agent, is conducted along a tube that enters a body supporting the whole assembly.

The lubrication is obtained by a pump entrained by a shaft, and the suspension of the assembly inside the housing is realized by springs arranged radially or perpendicular to the horizontal plane and fitting in lugs fixed on the housing and on the respective assembly.

The supply of energy is performed through a three-pole terminal disposed near the suction tube conducting the working agent from the evaporator.

These compressors have the following disadvantages, the fitting of suspension springs of the compressor assembly, requiring the use of inner lugs, leads to a larger size of the housing; and the mounting of the suction tube through which the cold vapor of the working fluid enters, leads to the heating of the vapor and implicitly to the diminution of the volumetric efficiency of the compressor.

Further the oil pump, and its pallet, are attached by pressing which does not secure a reliable contact therebetween. Also the total capacity of the pump is low.

Still another disadvantage is the tube, through which the suction of the working agent in the cylinder subassembly is conducted, the manner of suspension, the large clearance between the moving parts, and their weight, leading to a high noise level.

OBJECTS OF THE INVENTION

It is therefore the principal object of the present invention to provide a domestic refrigerator with a high efficiency and of better power consumption.

SUMMARY OF THE INVENTION

A compressor for domestic refrigerators, according to the invention has smaller dimensions compared with known compressors by reorganizing its interior subassemblies, by mounting of a new oil pump and by redesigning of the shaft on which the pump is set as well as by fitting a suction body for receiving the working agent directly from the evaporator on the cylinder. In this case the vapors are cold, with a small specific volume, and the oil pump can be reliable and have a high pumping efficiency.

According to the invention, the compressor for domestic refrigerators has an electric motor that, by means of a shaft and an eccentric, entrains a piston gliding in a cylinder subassembly. Such a structure eliminates the mentioned disadvantages of the prior art and solves the problem by the fact that the structure is provided with a hollow body disposed so that a circular hole of the body, through which the working fluid enters the cylinder subassembly is aligned with a tube bringing vapor from the evaporator. A three-pole terminal for distributing energy is disposed opposite to the tube. The motor is supported on springs mounted on the bottom of the housing and has an oil pump mounted in the shaft by a ring, fitted in a tapered circular groove.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
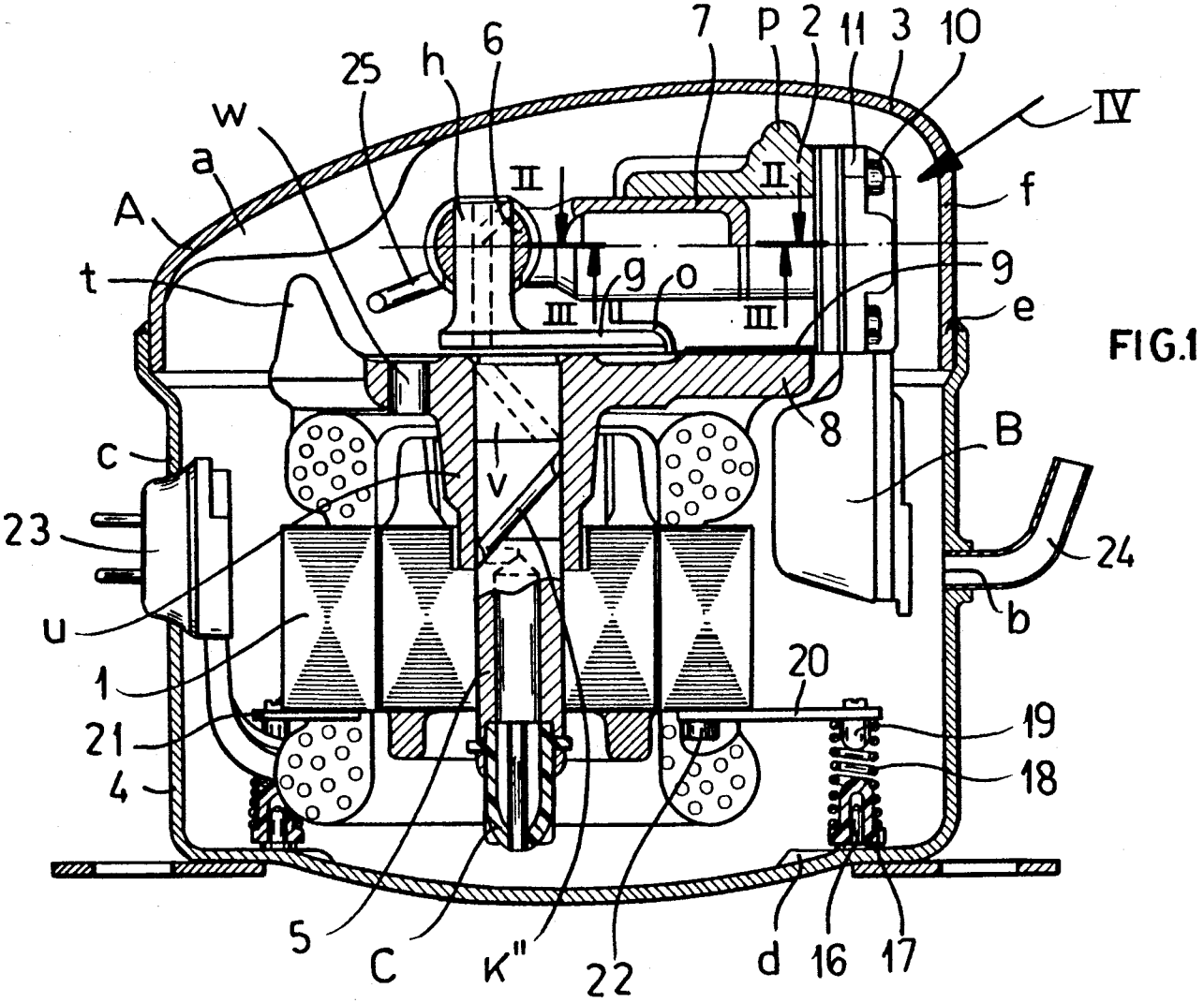
FIG. 1 is a longitudinal sectional of the compressor for refrigerators according to the invention.

According to the invention, the compressor has a housing A, inside of which there are a suction body B and a pump C, together with an electric motor and a cylinder subassembly 2.

The housing A is constituted of upper and lower housing parts 3 and 4, tightly secured together, for instance by welding.

The upper housing part 3 has prominences a, on each side of its major axis, and the lower housing part 4 has small and large holes b and c, which are antipodal (i.e. opposite one another), and having the centers in the same plane, as well as planar surfaces d, arranged at four points spaced from one another.

The upper housing part 3 has a lower section e of oval shape, and a higher section asymmetrical for reducing noise emission.

The rotation movement of motor 1 is transmitted via a shaft 5, and a slide block 6 to a piston 7, mounted in the cylinder subassembly 2.

The shaft 5 has a counterbalance g which is antipodal to an eccentric h in connection to which is assembled the slide block 6.

Figure 2:
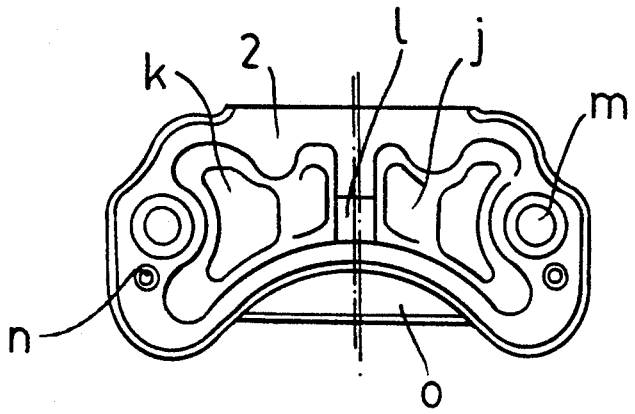
FIG. 2 is a bottom view of the cylinder subassembly.
Figure 3:
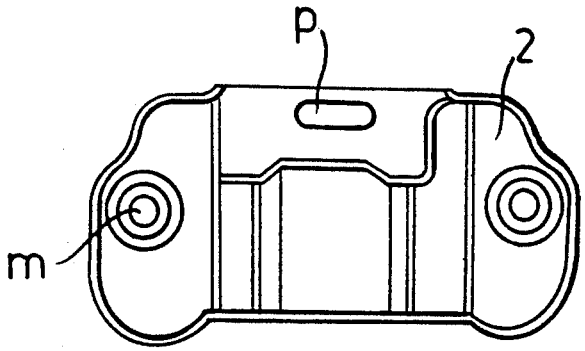
FIG. 3 is a top view of the cylinder subassembly.

As shown in FIG. 2 the cylinder subassembly 2 has an axial hole i, near which there are openings j and k, that are linked by a short open track l.

In each part of the openings j and k, the cylinder and subassembly has through holes relatively large m and smaller holes n.

The counterbalance g enters partially in an exterior groove o, formed in the cylinder subassembly 2. In order to support the assembly during transportation, the cylinder subassembly has a lug p, near the section f of the semi-housing 3.

Figure 4:
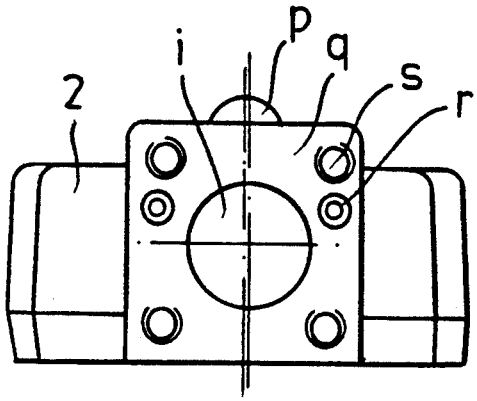
FIG. 4 is a frontal view of the cylinder subassembly.

At the level of a frontal surface q, in the cylinder subassembly 2 there are tracks r, with parallel axis and with blind holes s better seen in FIG. 4.

The cylinder subassembly 2 is fastened on a body 8 by any known fastening means, for example, screws, inserted in the through holes, their position is realized by some plugs, that are also not represented in the drawings, set in the blind holes n, and between the cylinder subassembly 2 and body 8 is attached an elastic packing 9.

The body 8 has spurs t extending upright, placed at the level of prominence a of the semi-housing 3, and openings at the level of openings j and k (shown in FIG. 2).

At the bottom, the body 8 has a nub u (FIG. 1) receiving an upper part of v of a shaft 5, and the counterbalance g is placed above the body 8.

The body 8 is formed with passages w, provided near the hub u. At least two of them are provided and terminated at the level of cylinder assembly 2.

Figure 5:
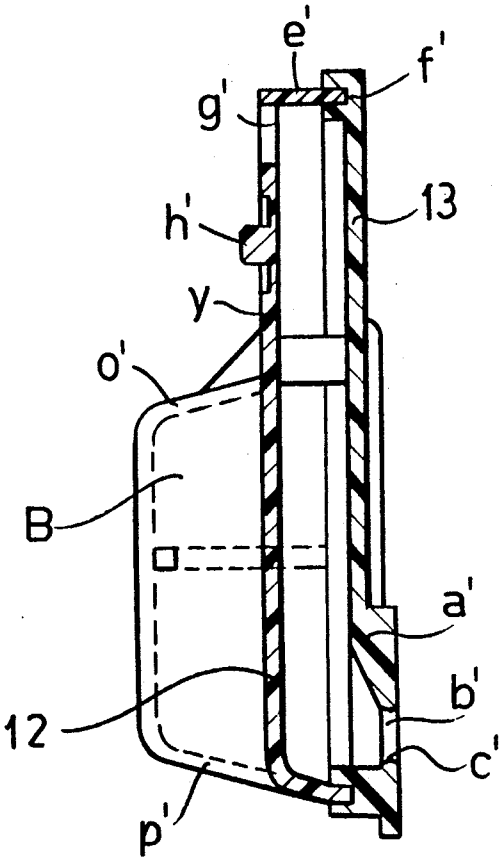
FIG. 5 is a longitudinal section view of the hollow article.

At the level of surface g, on the cylinder subassembly 2 are fastened with screws 10, that enter in the holes s, a suction assembly 11' customarily including a suction valve, a valve seating, a pushing valve and, respectively, a fitting and closed by a cylinder-head cover 11. The last has a lower opening and a axial groove receiving a neck y of a part 12 of the body B as shown in FIGS. 1 and 5, that also has a cover 13, tightly stiffened in a usual manner, for instance by soldering with the part 12.

Figure 6:
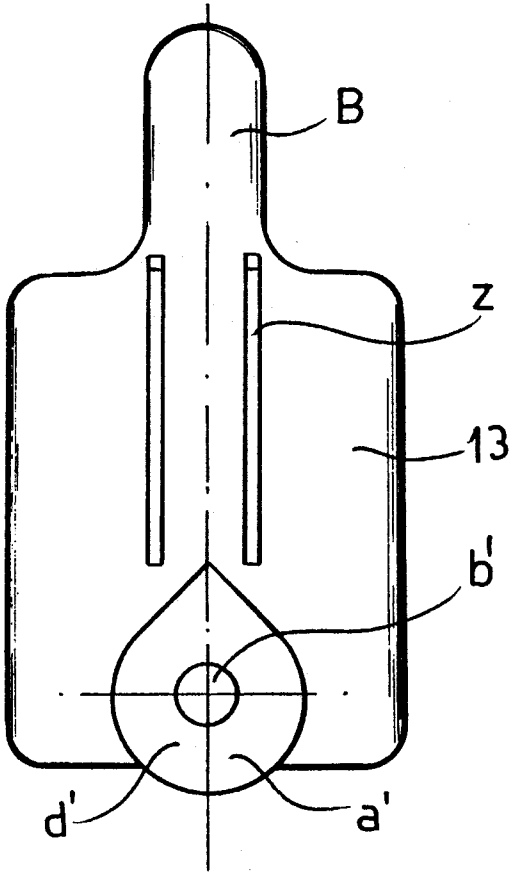
FIG. 6 is a frontal view of the hollow article.

The cover 13 has longitudinal ribs z shown in FIG. 6 and placed symmetrically against the body's symmetry axis. Between the ribs at the bottom, it is provided with a formation a, having the form of a drop (i.e. a droplet shape), whose symmetry axis coincides with the axis of cover 13. The formation a', is provided with a suction hole b', delimited by a wall c' convergent, whose center coincides with the center of a lower section d', of the prominence a'.

For joining the neck and cover a collar e' of the part 12 is provided with the cover 13. The latter has a track f', which partially receives the collar e'.

In the part 12 there is an upper hole g', under which is placed a formation h' for positioning the hole g', in relationship with the valve seat.

Figure 9:
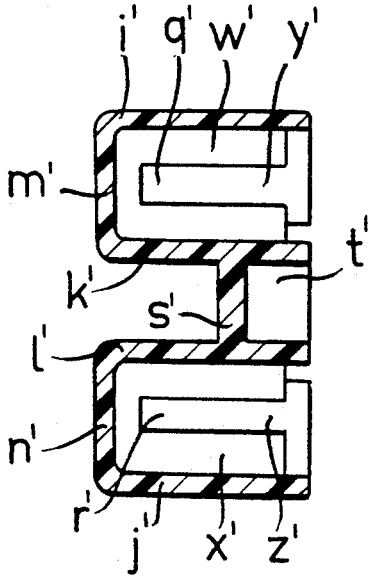
FIG. 9 is a cross-sectional view through the hole.
Figure 10:
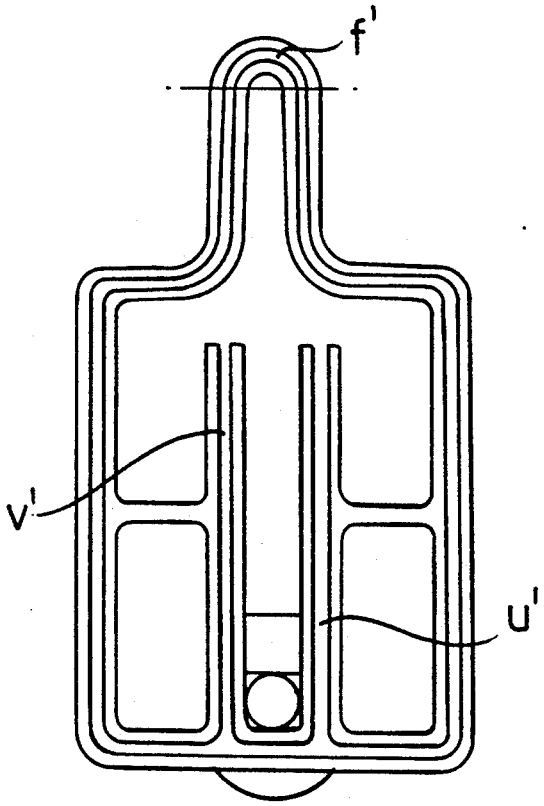
FIG. 10 is an rear view of the cover.

At the level of the ribs z the part 12 has walls j, k' and l' upright, outer and inner shown in FIG. 9 that, with upright walls m' and n', respectively beveled walls o' and p', upper and lower, delimit walls g' and r'. The inner walls k' and l' are linked by a medium walls s' that, with the walls r' and l', delimit a medium chamber f'.

In the cover 13 there are also upright tracks u' and y', in which enter partially the walls k' and l', so that chamber f' is separated from the exterior by cover 13. Upper chambers g' and r', in order to reduce the noise level during the passage of the refrigerant. For the same purpose, in the chambers g' and r' are provided with central walls w' and x', where there are some passages y' and z'.

Figure 8:
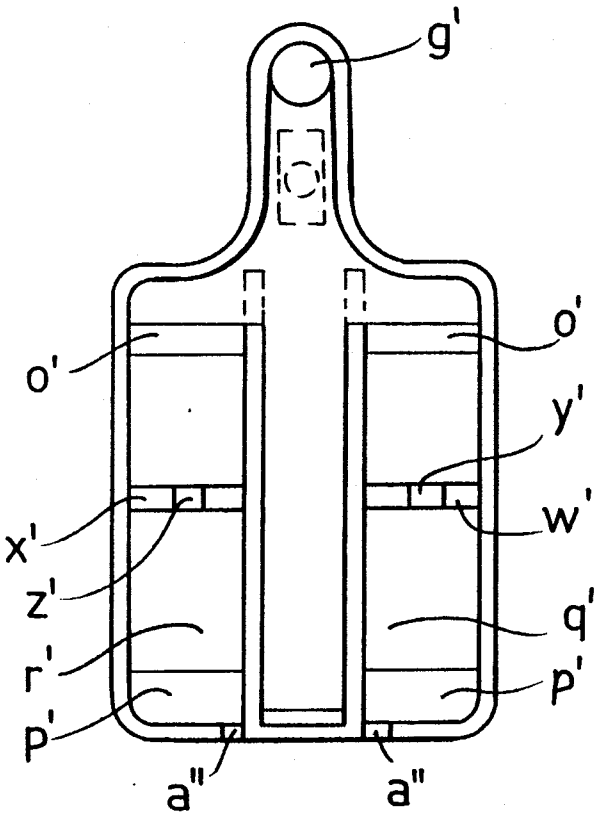
FIG. 8 is a frontal view of the hole of the hollow article.
Figure 7:
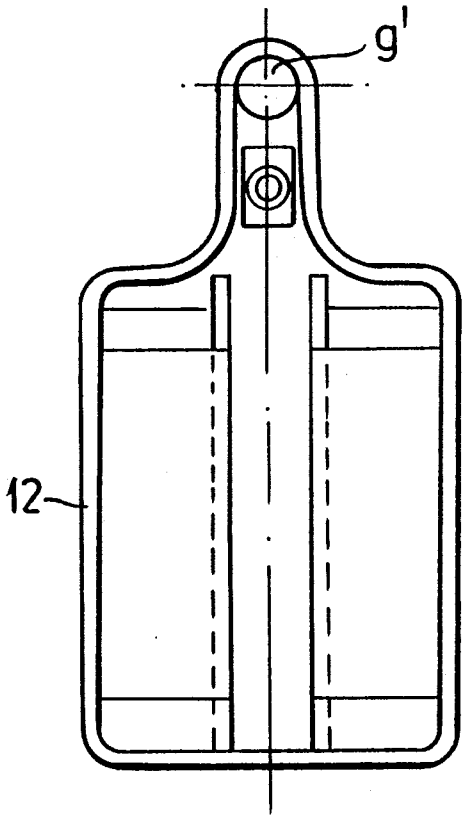
FIG. 7 is a rear view of the hollow article.

Lower, in the collar e' are (FIG. 8) machined throughholes a''. The suction hole b' for the cover 13, with the center placed on the same axis on which is placed the center of the hole b (FIG. 1) forming the semi-housing 4.

Figure 12:
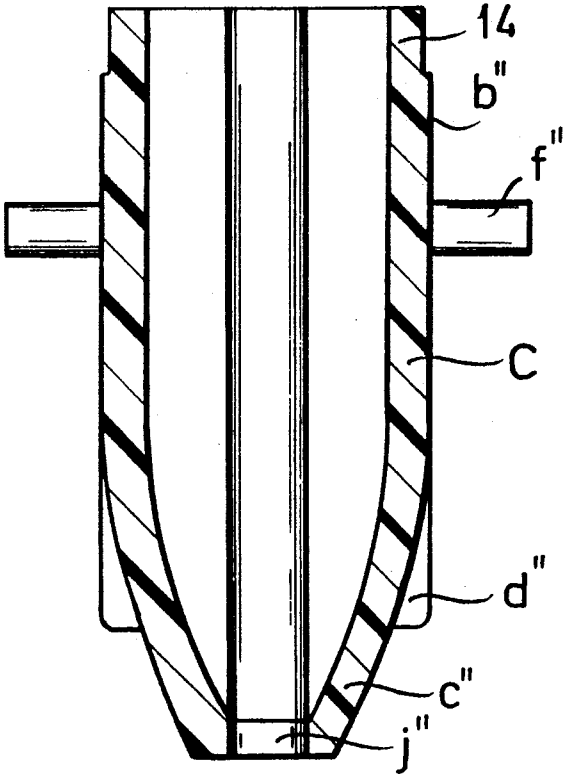
FIG. 12 is a longitudinal section in the oil pump.

The pump C is made of a body 14, (FIG. 12) with sections b'' and c'', cylindrical upper and ogival lower, at the level of such c'' radial pallets d'' are provided.

Figure 13:
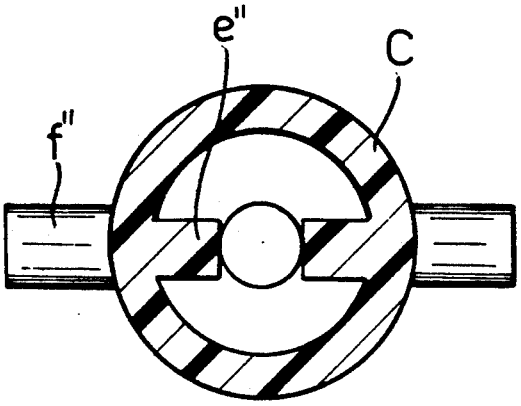
FIG. 13 is a cross-sectional view in the oil pump.

Inside the body 14 (FIG. 13) there are longitudinal pallets e''. At the level of section b', the body 14 has some spurs f'' symmetrically placed and entering seatings g'' formed in the shaft 5, so as a track b'' formed axially, receives partially the section b''.

Figure 11:
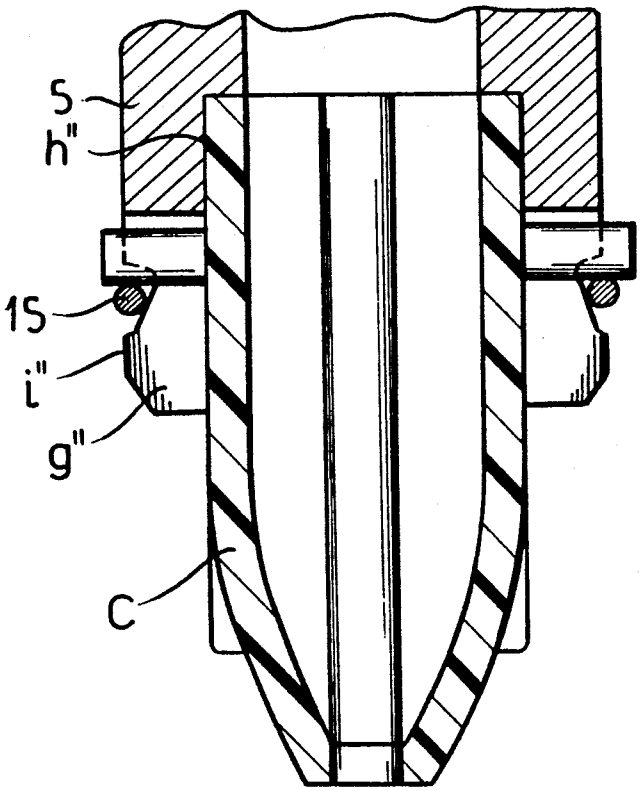
FIG. 11 is a detail of the oil pump used for the compressor for domestic refrigerators.

The mounting of the body 14 in the shaft 5, is done with a flexible ring 15, (FIG. 11) that is in contact with a wall i'', of taper shape, in order to ensure the front contact of body 14 with shaft 5.

The lower housing part 4 contains oil, in which the section c'' of body 14 is dipped. On the surfaces d (FIG. 1) are fastened lower guidings 16, mounted on supports 17, provided with compression springs 18, fastened on upper support 19, strengthened in their turn, two by two, on one of the plates 20 and 21.

The guidings 16 and 19 are coaxial and are placed in the points of a quadrilateral having the center of gravity at the vertical projection of the center of gravity of the supported weight. In order to maintain the position of the supported weight. the plates 20 and 21 are dimensioned so that they afford only limited displacements in a horizontal plane, by contact with the lower housing part 4. The body 8 is fastened on the plates 20 and 21, with some screws 22, that also pass through the motor 1.

A supply of energy of motor 1, is realized by a three-pole terminal 23, placed in the hole e of the semi-housing, the connection of terminal 23 to the motor 1 being made in its proximity.

After starting the motor 1, the pump C is turned by shaft 5, so that the oil is entrained upward by a lower hole j'' of body 14, passing through a track k'' (FIG. 1) spiral-shaped, outside the shaft 5, up to the contact with the semi-housing 3.

As a result of the impact with the upper housing part 3, the screen made of oil drops moves down, coming in contact with the assembly supported by the lower housing part 4, and with the housing A inside, the oil passing also through the openings w, formed in the body 8.

The refrigerant passes through a pipe 24, joined with the lower housing 4 at the level of the hole b formed in the low housing part and enters through the hole b' in the suction body B, through which it passes, through the median chamber f' at the level of hole g', through which it gets out, and enters in the cylinder subassembly 2 where is compressed and sent in the opening of the cover 11, from which it is discharged after passing through the holes r and through the openings j and k, through a pipe 25, connected with the cover 11.

The oil from chamber g' and r' can flow out, during stopping, through the holes a'', and the oil sent by the ribs z because of the shape of the prominence a', avoids hole b'.

According to the invention, the compressor offers the following advantages:

it leads to increasing of the storing space in the cabinet by decreasing the dimensions of the housing;

increasing of the refrigeration efficiency by increasing the specific refrigeration power and decreasing of power consumption;

reduction at the minimum of the noise level and vibrations;

reduction of time required for fabrication;

increase of reliability.

We claim:

1. A compressor for a domestic refrigerator comprising:

a housing formed with an upper housing part and a lower housing part fitted together;

an electric motor resiliently mounted in said lower housing part and having an upwardly extending shaft formed with passages displacing oil from said lower housing part into said upper housing part;

an eccentric formed on an upper end of said shaft;

a horizontal piston-and-cylinder assembly comprising a cylinder mounted on said motor and a piston connected to said eccentric and reciprocatable thereby, said cylinder having an intake port opening at and end of said cylinder;

a suction body affixed to said end of said cylinder and formed with a downwardly extending passage, said suction body extending downwardly along side said motor and having a suction port at a lower portion of said body turned toward a whole formed in a wall of said lower housing part spaced from said suction port but aligned therewith; and a pipe connected to said wall and aligned with said hole for delivering a refrigerant to said housing whereby said refrigerant is drawn into said body through said suction port upon reciprocation of said piston in said cylinder, said body being formed with a plurality of chambers along which said passage extends and is provided externally with a flat teardrop-shaped prominence surrounding said suction port, a pair of ribs projecting from said body toward said wall parallel to one another above said teardrop-shaped prominence.

2. The compressor defined in claim 1 wherein said chambers are defined by a plurality of vertical and horizontal walls.

3. The compressor defined in claim 2 wherein said cylinder is generally of ogival cross section.

4. The compressor defined in claim 3 wherein said motor is supported on a plurality of spaced apart springs on said lower housing part.

* * * * *

UNITED STATES PATENT AND TRADEMARK OFFICE

CERTIFICATE OF CORRECTION

PATENT NO. : 5,228,843
DATED : July 20, 1993
INVENTOR(S) : Novolan, et. al.

It is certified that error appears in the above-indentified patent and that said Letters Patent is hereby corrected as shown below:

Title page, item [75], inventor: second inventor's last name should read--Ungureanu--.

Signed and Sealed this

Twenty-sixth Day of April, 1994

Bruce Lehman

BRUCE LEHMAN

*Commissioner of Patents and Trademarks*

*Attest:*

*Attesting Officer*